US008246137B2

(12) United States Patent
Lockwood

(10) Patent No.: US 8,246,137 B2
(45) Date of Patent: Aug. 21, 2012

(54) IMAGE FORMING APPARATUS AND METHODS THEREOF

(75) Inventor: Robert J. Lockwood, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 158 days.

(21) Appl. No.: 12/847,520

(22) Filed: Jul. 30, 2010

(65) Prior Publication Data

US 2012/0026231 A1 Feb. 2, 2012

(51) Int. Cl.
*B41J 29/38* (2006.01)
*B41J 2/01* (2006.01)

(52) U.S. Cl. ..... 347/16; 347/101

(58) Field of Classification Search ..... None
See application file for complete search history.

(56) References Cited

U.S. PATENT DOCUMENTS

| | | | | |
|---|---|---|---|---|
| 5,825,378 | A | 10/1998 | Beauchamp | |
| 6,364,549 | B1 * | 4/2002 | Lesniak et al. | 400/74 |
| 2002/0063871 | A1 * | 5/2002 | Kinas | 358/1.4 |
| 2008/0007586 | A1 * | 1/2008 | Yoshida et al. | 347/16 |
| 2010/0078870 | A1 | 4/2010 | Fellingham et al. | |

* cited by examiner

*Primary Examiner* — Geoffrey Mruk

(57) ABSTRACT

A method of calibrating a transport roller includes forming a reference image through nozzles arranged in an array having an array height, moving a substrate a distance along a substrate transport path by the transport roller having a radius and a circumference, and determining an offset value based on an actual distance of substrate advancement corresponding to the reference image and movement of the transport roller. The circumference of the transport roller is equal to or less than at least one of the array height of the nozzle array or an image height of the reference image.

13 Claims, 6 Drawing Sheets

IMAGE FORMING APPARATUS AND METHODS THEREOF

BACKGROUND

Image forming apparatuses such as inkjet printers transport a substrate to be printed upon by a fluid ejector unit along a substrate transport path.

BRIEF DESCRIPTION OF THE DRAWINGS

Exemplary non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses such as inkjet printers include a transport roller having a radius and a circumference. The transport roller may move a substrate a distance along a substrate transport path on which to be printed, for example, by a fluid ejector unit. Movement of the substrate an accurate distance along the substrate transport path assists in formation of high quality images and proper operation of the image forming apparatus. The substrate tangent to an outer surface of the transport roller, for example, may move an expected distance equal to the radius of the transport roller multiplied by angular movement (e.g., angle of rotation) of the transport roller. In practice, however, the actual distance moved by the substrate may differ from the expected distance, for example, based on a variation in the radius of the transport roller and/or runout error. In examples of the present disclosure, a determination unit is disclosed that accurately detects the actual distance of substrate advancement, the expected distance of substrate advancement, and a difference between the actual distance and the expected distance of the substrate advancement to determine an offset value.

In examples, the actual distance is detected through use of a plurality of lines corresponding to actual distance reference values formed on the substrate by the fluid ejector unit through an array of nozzles with an array height equal to or greater than the circumference of the transport roller. Accordingly, the lines may be formed during a single pass of the fluid ejector unit reciprocating across the substrate. Subsequently, the actual distance of substrate advancement corresponding up to a full rotation of the transport roller may be obtained by detection of at least one of the plurality of lines. Thus, potential errors in positioning several subsets of lines formed over several passes of the fluid ejector unit across the substrate to form a complete line set to detect substrate advancement corresponding to the full rotation of the transport roller is avoided.

Figure 1A:
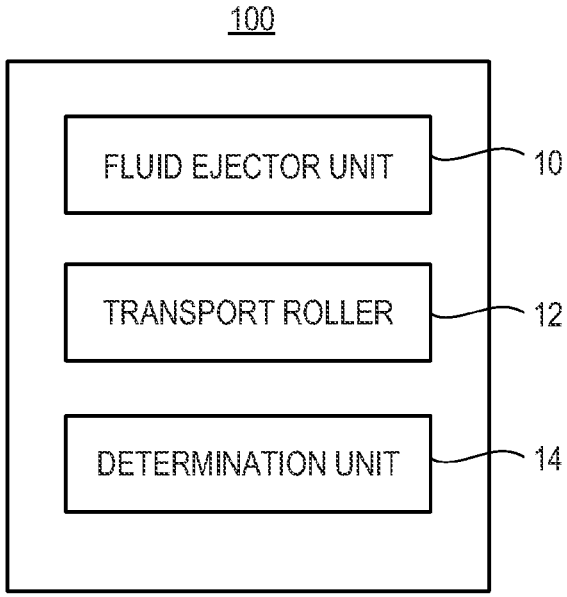
FIG. 1A is a block diagram illustrating an image forming apparatus according to an example of the present disclosure.
Figure 2:
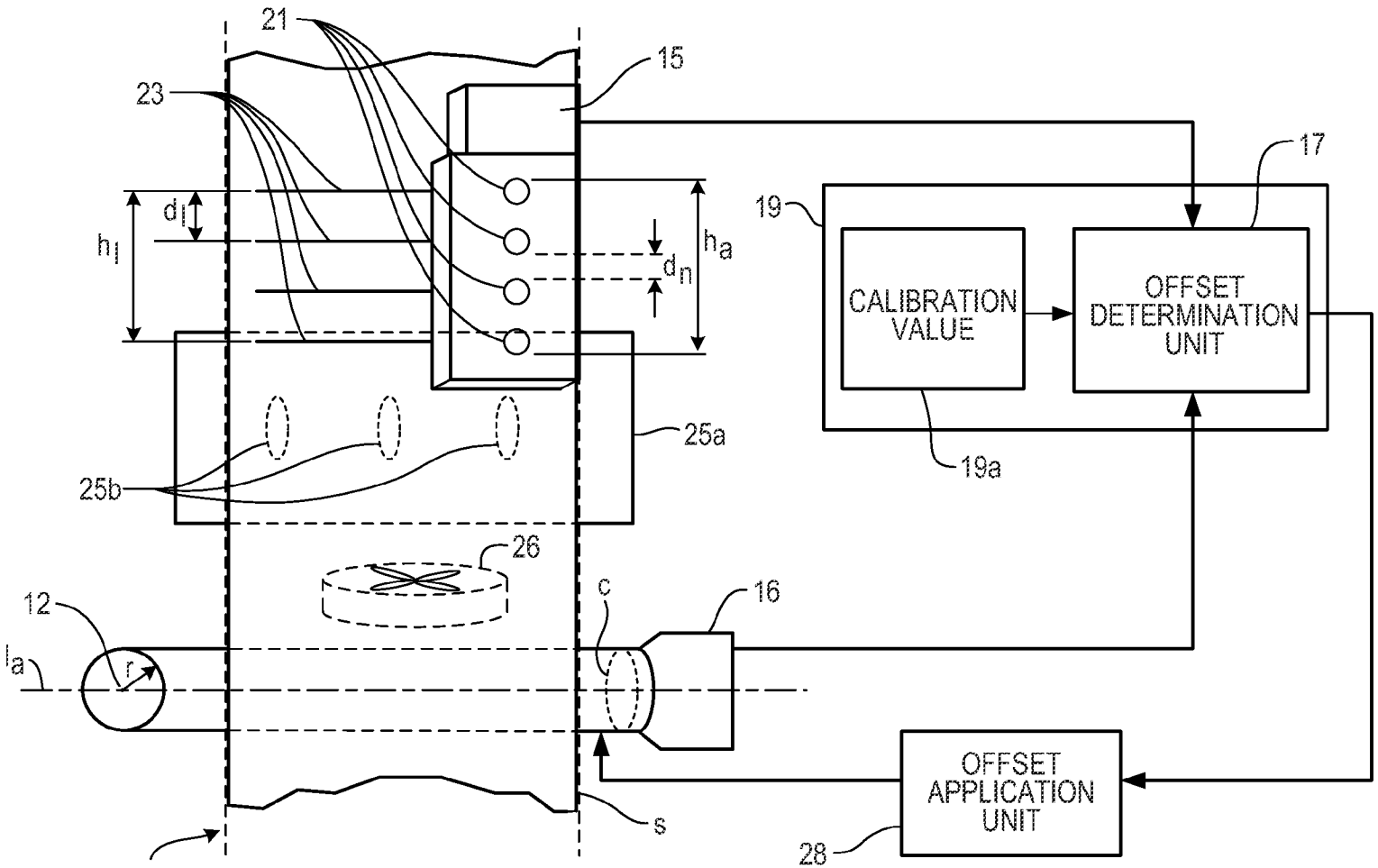
FIG. 2 is a perspective view of the image forming apparatus illustrated in FIGS. 1A-1C according to examples of the present disclosure.

FIG. 1A is a block diagram illustrating an image forming apparatus according to an example of the present disclosure. Referring to FIGS. 1A and 2, an image forming apparatus 100 may include a transport roller 12 having a radius r and a circumference c, a fluid ejector unit 10 and a determination unit 14. The transport roller 12 may be configured to move a substrate S a distance along a substrate transport path 29. In the present example, the fluid ejector unit 10 such as a reciprocating inkjet print head may include a plurality of nozzles 21 arranged in an array having an array height $h_a$ in a direction transverse to the substrate transport path 29 equal to or greater than the circumference c of the transport roller 12. In an example, the fluid ejector unit 10 may be configured to eject fluid such as ink through the nozzles 21 to form a plurality of lines 23 corresponding to actual distance reference values of substrate advancement on the substrate S. The number of nozzles 21 and lines 23 illustrated herein are for illustrative purposes only as the number of nozzles 21 and lines 23 can vary in accordance with the disclosure.

Referring to FIGS. 1A and 2, the determination unit 14 may be configured to determine an offset value based on a difference between an actual distance of the substrate advancement along the substrate transport path 29 based on at least one line of the plurality of lines 23 and an expected distance based on an amount of movement of the transport roller 12. As the array height $h_a$ is at least equal to or greater than the circumference c of the transport roller 12, a complete set of lines 23 may be formed by the fluid ejector unit 10 in a single pass across the substrate transport path 29. The complete set of lines 29 allows the determination unit 14 to determine the actual distance of substrate advancement corresponding up to at least a full rotation of the transport roller 12. Accordingly, the determination of the offset value may be used to calibrate the transport roller 12 and/or roller runout.

In the present example, the determination unit 14 can be implemented in hardware, software including firmware, or combinations thereof. The firmware, for example, may be stored in memory and executed by a suitable instruction-execution system. If implemented solely in hardware, as in an alternative example, the determination unit 14 can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the determination unit 14 can be implemented in a combination of software and data executed and stored under the control of a computing device.

Figure 1B:
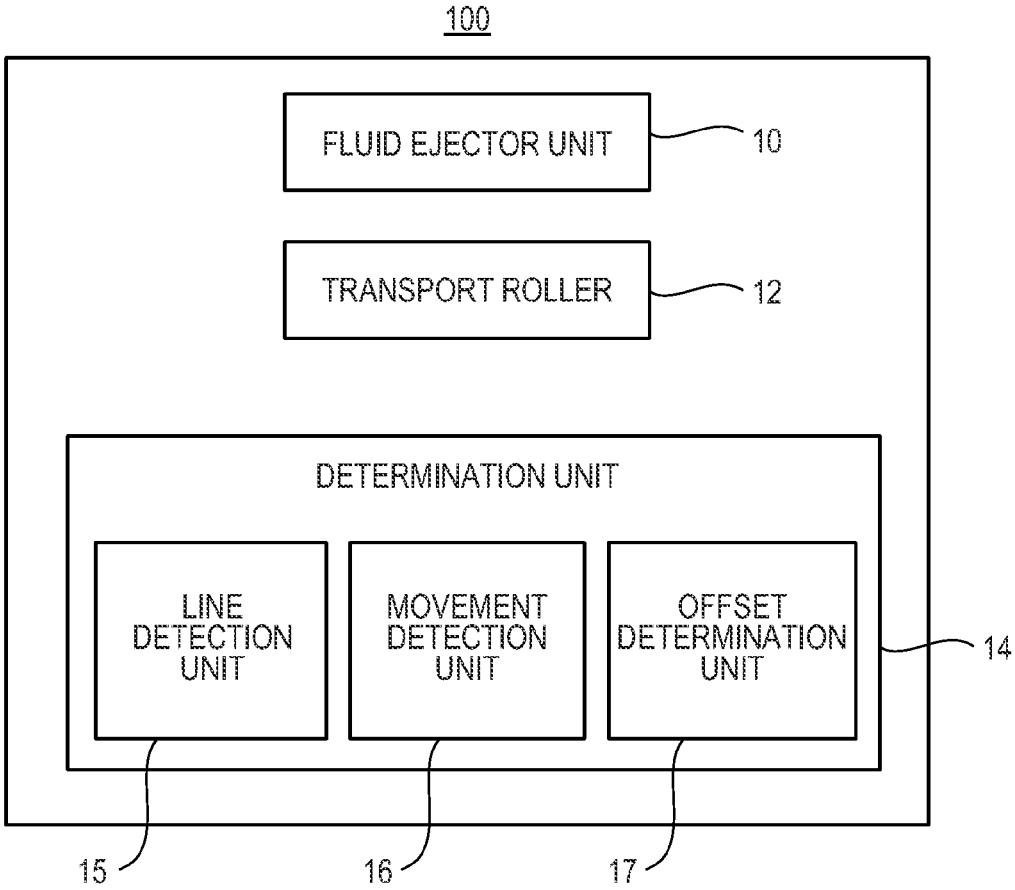
FIG. 1B is a block diagram of the image forming apparatus of FIG. 1A further illustrating the determination unit according to an example of the present disclosure.

FIG. 1B is a block diagram of the image forming apparatus of FIG. 1A according to an example of the present disclosure. As illustrated in FIG. 1B, the image forming apparatus 100 includes the fluid ejector unit 10, the transport roller 12 and the determination unit 14 as illustrated and described with reference to FIG. 1A. Referring to FIGS. 1B and 2, the determination unit 14 may further include a line detection unit 15, a movement detection unit 16 and an offset determination unit 17. The line detection unit 15 may be configured to detect the lines 23 formed by the fluid ejector unit 10. In the present example, the line detection unit 16 may be an optical sensor disposed downstream from the fluid ejector unit 10 in the substrate transport direction 29. The movement detection unit 16 may be configured to detect movement of the transport roller 12 such as angular movement $\alpha$ thereof. The movement detection unit 16 may be an encoder sensor disposed on the transport roller 12. For example, the movement may detect a number of degrees in which the transport roller 12 rotates, or the like. In an example, the movement detection unit 16 may also include an index sensor. Thus, the movement detection unit 16 may detect an absolute angular change of the transport roller 12.

The movement detection unit 16 may be configured to detect the amount of movement of the transport roller 12. The offset determination unit 17 may be in communication with the line detection unit 15 and the movement detection unit 16. In an example, the offset determination unit 17 may be configured to determine the offset value based on the difference between the actual distance and the expected distance of substrate advancement along the substrate transport path 29. The actual distance of substrate advancement may be determined based on the detection of the at least one line by the line detection unit 15. The expected distance may be determined based on the detection of the amount of movement of the transport roller 12 by the movement detection unit 16.

Figure 1C:
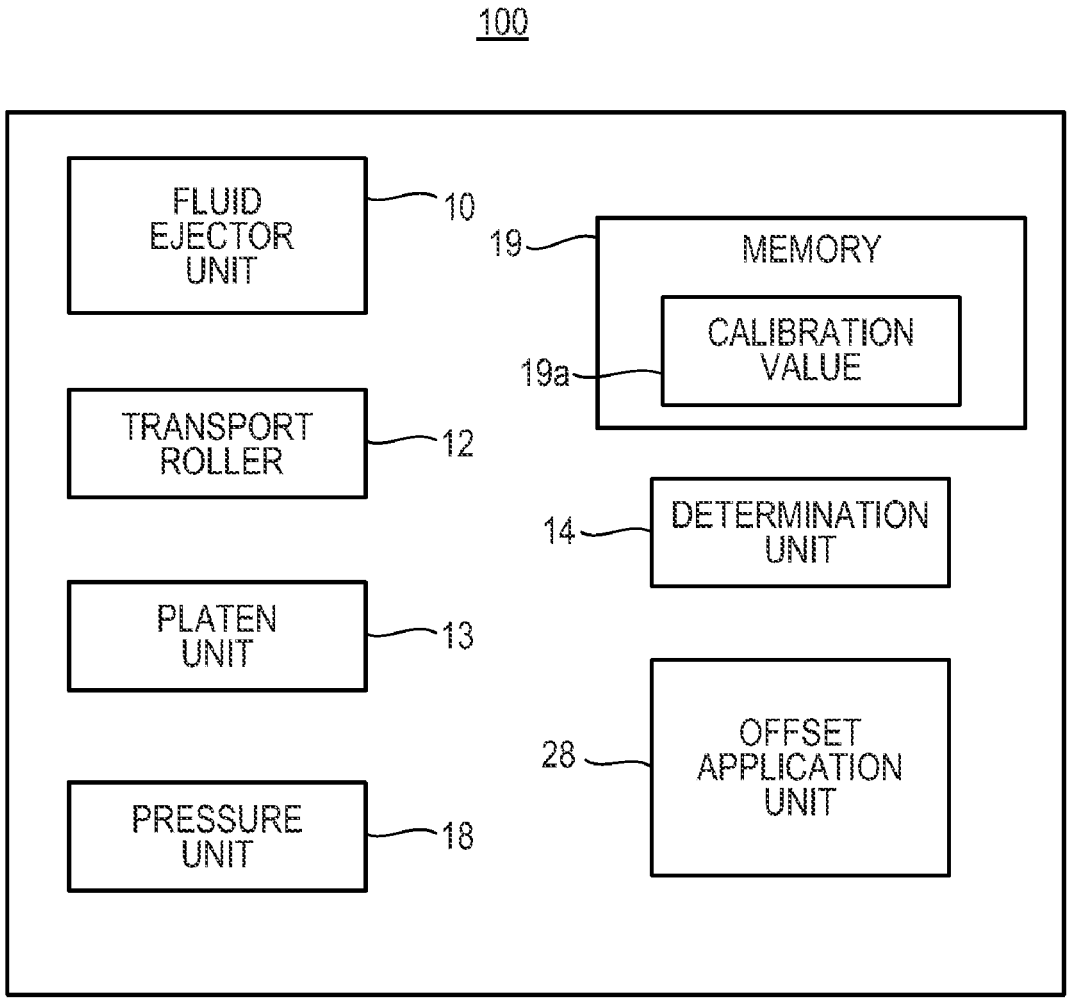
FIG. 1C is a block diagram of the image forming apparatus of FIG. 1A according to an example of the present disclosure.

FIG. 1C is a block diagram of the image forming apparatus of FIG. 1A according to an example of the present disclosure. As illustrated in FIG. 1C, the image forming apparatus 100 includes the fluid ejector unit 10, the transport roller 12 and the determination unit 14 as illustrated and described with reference to FIG. 1A. Referring to FIGS. 1C and 2, the image forming apparatus 100 may also include a platen unit 13, a pressure unit 18, an offset application unit 28, and memory 19 such as firmware. In the present example, the platen unit 13 may be disposed across from the fluid ejector unit 10. The platen unit 13 may be configured to receive the substrate S. The pressure unit 18 may be configured to apply pressure to orient the substrate S with respect to the platen unit 13 and the fluid ejector unit 10. For example, the substrate S may be pressed against the platen unit 13 to maintain a predetermined distance between substrate S and the fluid ejector unit 10 to prevent image defects and obstruction of print head movement across the substrate transport path 29. Alternatively, the pressure unit 18 may be an electrostatic unit configured to generate electrostatic energy to orient the substrate S against the platen unit 13.

In an example, the offset application unit 28 communicates with the offset determination unit 17 and the transport roller 12. Referring to FIG. 1C, the offset application unit 28 may be configured to selectively apply the offset value determined by the offset determination unit 17 to the transport roller 12. For example, the offset application unit 28 may apply the offset value through increasing or decreasing the amount of rotation of the transport roller 12. In the present example, the offset application unit 28 can be implemented in hardware, software including firmware, or combinations thereof. The firmware, for example, may be stored in memory and executed by a suitable instruction-execution system. In examples, the offset application unit 28, the determination unit 14 and/or a portion thereof such as, for example, the offset determination unit 17 may be stored in the memory 19.

Referring to FIGS. 1C and 2, the fluid ejector unit 10 may include nozzle variations and drop placement errors resulting from the manufacturing process. Such issues may be identified and compensated for through a calibration value 19*a*, for example, provided by the manufacturer. In an example, the calibration value 19*a* may correspond to a variation of at least one of the nozzle spacing distance $d_n$ and drop placement stored in the memory 19. Accordingly, in examples, the calibration value 19*a* may be factored into the offset value. Referring to FIG. 1C, in an example, the calibration value 19*a* may be added to the offset value determined by the determination unit 14. For example, the calibration value 19*a* may be represented in or converted to units of degrees corresponding to an amount of angular movement $\alpha$ of the transport roller 12.

Figure 3A:
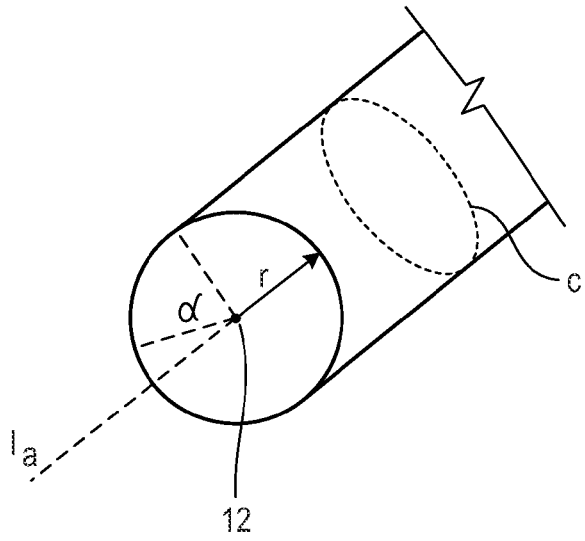
FIG. 3A is a perspective view of a portion of the transport roller of the image forming apparatus illustrated in FIG. 2 according to an example of the present disclosure.
Figure 3B:
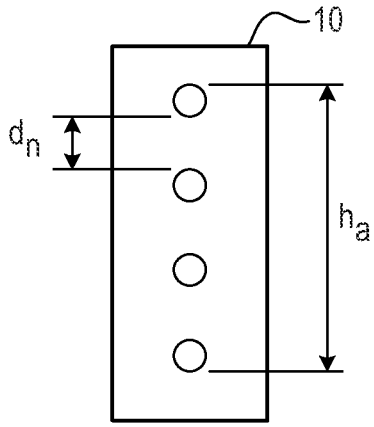
FIG. 3B is a front view illustrating a fluid ejector unit of the image forming apparatus of FIG. 2 according to an example of the present disclosure.

FIG. 2 is a schematic view of the image forming apparatus illustrated of FIGS. 1A-1C according to examples of the present disclosure. Referring to FIGS. 1A-1C and 2, the image forming apparatus 100 includes a transport roller 12 having a radius r, a circumference c and a longitudinal axis $l_a$ thereof. The transport roller 12 may be configured to move a substrate S a distance along the substrate transport path 29. In an example, the transport roller 12 may rotate along the longitudinal axis $l_a$ in which angular movement $\alpha$ of the transport roller 12 corresponds to an expected distance of substrate advancement along the substrate path 29. That is, the expected distance of substrate advancement may equal the value obtained by multiplying the radius r by the angular movement $\alpha$ (converted into radians) of the transport roller 12 as illustrated in FIG. 3B and identified in Equation 1. For purposes of illustration, an application of Equation 1 for a transport roller 12 having a radius of 0.5 inches and rotating 180° about its longitudinal axis $l_a$ results in the expected distance $d_e$ of the substrate advancement equal to 1.57 inches.

$$d_e=\alpha\times r=\alpha\times\pi/180°\times r; \qquad \text{EQUATION 1:}$$

where $d_e$ is expected distance of the substrate advancement;

r is radius of the transport roller;

$\alpha$ is angular movement (e.g., angle of rotation) of the transport roller expressed in degrees; and $\pi/180°$ is a conversion factor to convert degrees to radians.

Referring to FIGS. 2 and 3B, in the present example, the fluid ejector unit 10 such as a reciprocating inkjet print head includes a plurality of nozzles 21 arranged in an array having an array height $h_a$ in a direction transverse to the substrate transport path 29 equal to or greater than the circumference c of the transport roller 12. For purposes of illustration, the array height $h_a$ may be 3.14 inches (or greater) with respect to the transport roller 12 having the radius of 0.5 inches as illustrated in a previous example which is equal to the circumference c of the respective transport roller 12. In the present example, the nozzles 21 may be spaced apart from each other by a predetermined nozzle spacing distance $d_n$. In other examples, the nozzle array may include a plurality of columns (not illustrated).

The fluid ejector unit 10 may be configured to reciprocate across the substrate transport path 29 and/or the substrate S, and eject fluid such as ink through the nozzles 21 to form images. Referring to FIG. 2, in the present example, such images may include desired images such as pictures, reports, emails, or the like, and a reference image such as a plurality of lines 23 to calibrate the transport roller 12. Actual distance reference values of substrate advancement may correspond to the plurality of lines 23 formed on the substrate S. For illustrative purposes only, an actual distance reference value of 0.5 inches may correspond to a respective line to be detected by the line detection unit 15 in response to the substrate S actually moving a distance of 0.5 inches along the substrate transport path 29. Additional actual distance reference values such as 1 inch, 1.5 inches, and 2 inches may correspond to additional lines to be detected by the line detection unit 14 in response to the substrate S actually moving such respective distances. Although for purposes of illustration, a predetermined line spacing distance of 0.5 inches was chosen, any predetermined line spacing distance may be used in accordance with the disclosure. Such actual distance reference values may be stored, for example, in a lookup table in memory to be accessed by the determination unit 14.

In other examples, the detected lines 23 may be used to gather a number of data points. From the data points, a relationship may be identified to determine a respective offset value. For example, the relationship may be graphical presented as a line and a curve constructed from a mathematical best fit algorithm. In an example, a slope of the line may represent a larger or smaller than nominal radius and the curve may represent a sinusoidal offset such as amplitude and phase to compensate for runout error.

Figure 3C:
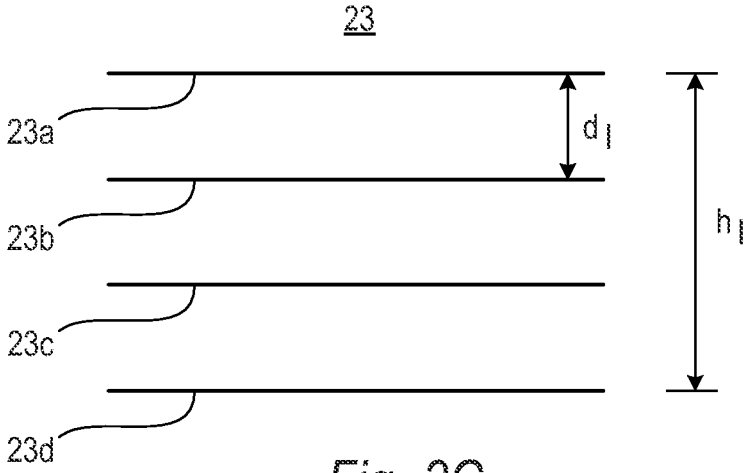
FIG. 3C is a top view of the plurality of lines formed by the image forming apparatus illustrated in FIG. 2 according to an example of the present disclosure.

Referring to FIG. 3C, in examples, the plurality of lines 23 may be spaced apart from each other by a predetermined line spacing distance $d_l$. A distance between a first line 23*d* and a last line 23*a* of the plurality of lines 23, for example, may be equal to the array height $h_a$ of the nozzle array. In an example, the plurality of lines 23 may be parallel and the predetermined line spacing distance $d_l$ may be equal to a nozzle spacing distance $d_n$ between nozzles 21 of the fluid ejector unit 10 in the direction transverse to the substrate transport path 29.

Referring to FIGS. 1B and 2, the offset determination unit 17 may be configured to determine the offset value. The offset value may be based on the difference between the actual distance and the expected distance of substrate advancement. The actual distance of substrate advancement may be based on the detection of the at least one line by the line detection unit 15. The expected distance may be determined based on the detection of the amount of movement of the transport roller 12 such as angular movement $\alpha$ by the movement detection unit 16. For purposes of illustration, the actual distance may be 1 inch and the estimated distance may be 1.57 inches as identified in a previous example of the transport roller 12 having a radius of 0.5 inches rotating 180°. Thus, in this example, the offset value would be 0.57 inches which corresponds to an angular movement of 65.317° or 1.14 radians. In this example, the actual distance identified as 1 inch corresponds to the respective line detected by the line detection unit 15 having an actual distance reference value of 1 inch. In the previous example having the predetermined line spacing of 0.5 inches, the line detection unit 15 may have detected the third line of the plurality of lines 23 as corresponding to the actual distance of substrate advancement.

Referring to FIG. 2, the platen unit 13 may include a plate member 25*a* having plate openings 25*b* in which air generated by the pressure unit 18 such as a vacuum fan 26 passes therethrough to exert pressure in the form of suction on the substrate S. In an example, vacuum fan 26 applies a vacuum pressure through the plate openings 25*b* onto the substrate S to position the substrate S against the plate member 25*a*. In other examples, the platen unit 13 may include a platen belt (not illustrated) against which the substrate S may be placed.

Figure 4:
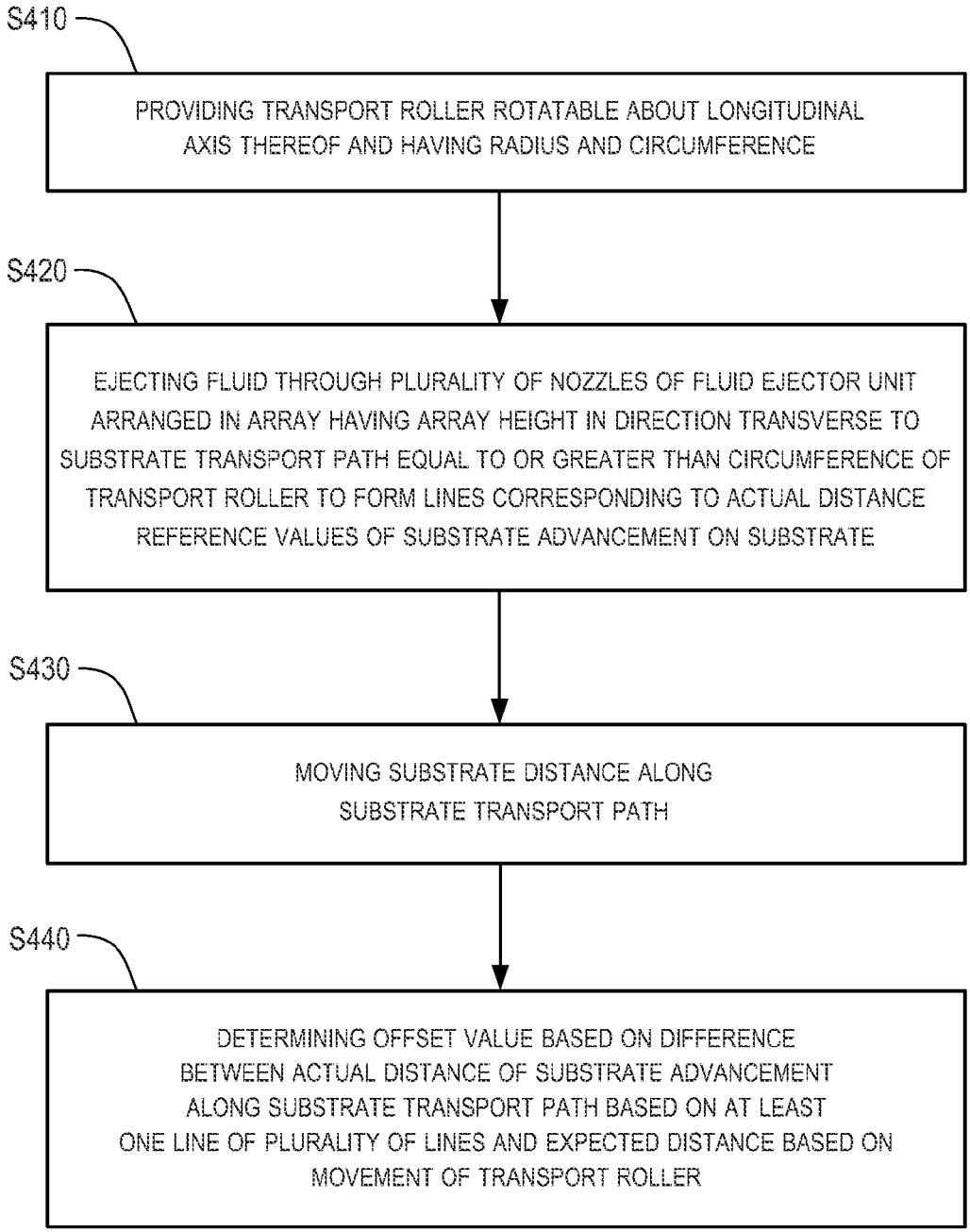
FIG. 4 is a flowchart illustrating a method of calibrating a transport roller of an image forming apparatus according to an example of the present disclosure.

FIG. 4 is a flowchart illustrating a method of calibrating a transport roller of an image forming apparatus according to an example of the present disclosure. Referring to FIG. 4, in block S410, a transport roller rotatable about a longitudinal axis thereof and having a radius and a circumference is provided. In block S420, fluid is ejected through a plurality of nozzles of a fluid ejector unit arranged in an array having an array height in a direction transverse to a substrate transport path equal to or greater than the circumference of the transport roller to form a plurality of lines corresponding to actual distance reference values of substrate advancement on a substrate. In block S430, the substrate is moved a distance along the substrate transport path. In block S440, an offset value is determined based on a difference between an actual distance of the substrate advancement along the substrate transport path based on at least one line of the plurality of lines and an expected distance based on angular movement of the transport roller.

In an example, determining the offset value may include detecting the plurality of lines formed by the fluid ejector unit, detecting the amount of angular movement of the transport roller, and determining the offset value. The offset value may be based on the difference between the actual distance and the expected distance of substrate advancement along the substrate transport path. The actual distance may be based on the detection of the plurality of lines. The expected distance may be based on the detection of the amount of the angular movement of the transport roller. In examples, the plurality of lines may be spaced apart from each other by a predetermined line spacing distance. For example, the predetermined line spacing distance may be equal to the nozzle spacing distance. A distance between a first line and a last line of the plurality of lines may be equal to the array height. In an example, each line may correspond to a respective nozzle of the nozzle array.

In an example, the method of calibrating a transport roller of an image forming apparatus as illustrated in FIG. 4 may also include selectively applying the determined offset value to the transport roller. For example, the offset value may be applied in a form of an increase or a decrease in the amount of angular movement of the transport roller. The method as illustrated in FIG. 4 may also include applying pressure to orient the substrate with respect to a platen unit and the fluid ejector unit.

Figure 5:
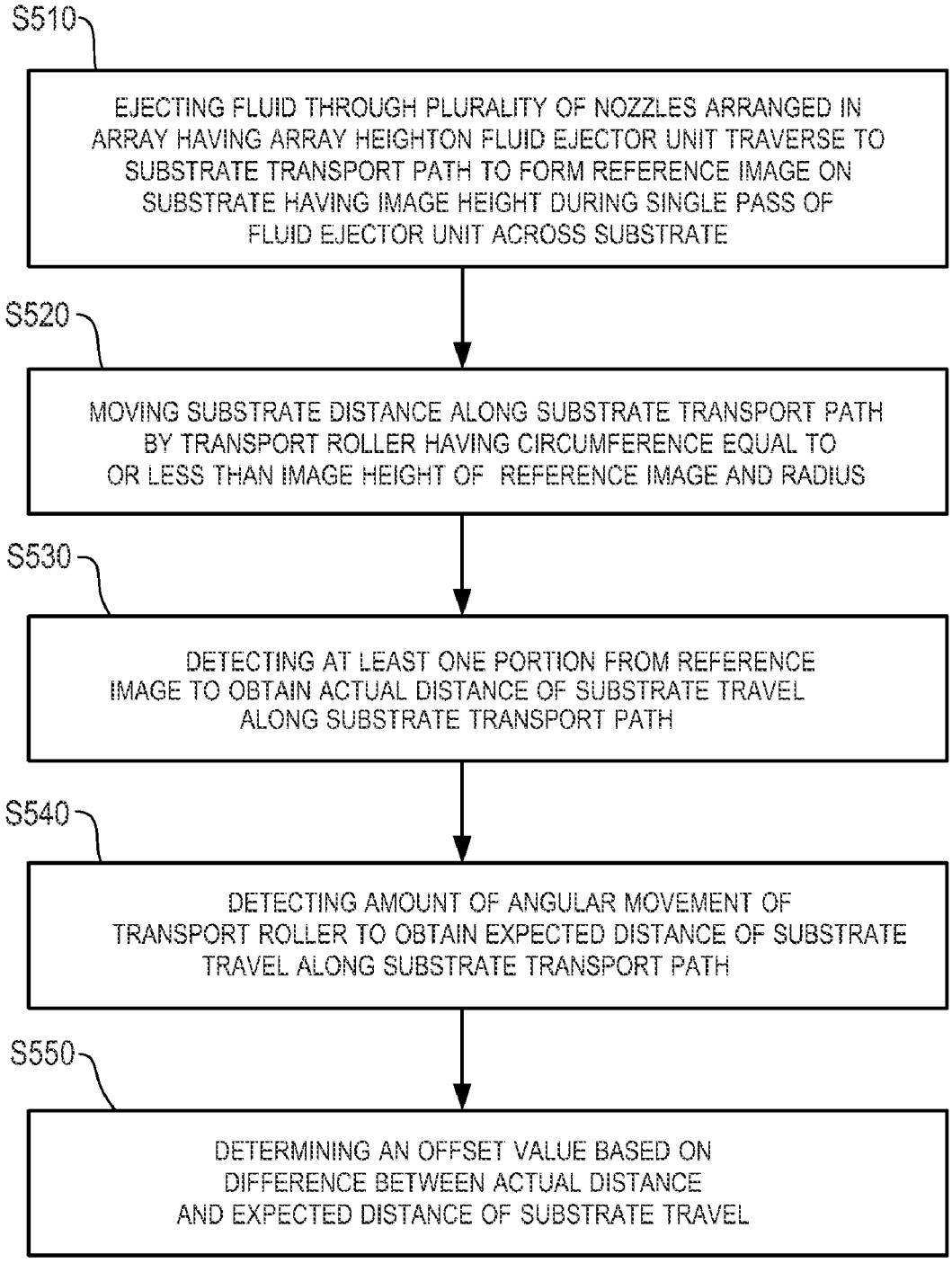
FIG. 5 is a flowchart illustrating a method of calibrating a transport roller of an image forming apparatus according to an example of the present disclosure.

FIG. 5 is a flowchart illustrating a method of calibrating a transport roller of an image forming apparatus according to an example of the present disclosure. Referring to FIG. 5, in block S510, fluid is ejected through a plurality of nozzles arranged in an array having an array height on the fluid ejector unit traverse to a substrate transport path to form a reference image on a substrate. The reference image having an image height is formed during a single pass of the fluid ejector unit across the substrate. In an example, the reference image may include a plurality of lines corresponding to actual distance reference values of substrate advancement on the substrate. In block S520, the substrate is moved a distance along the substrate transport path by a transport roller having a circumference equal to or less than the image height of the reference image and a radius. The array height of nozzles on the fluid ejector unit may be equal to or greater than the circumference of the transport roller. In block S530, at least one portion from the reference image is detected to obtain an actual distance of substrate travel along the substrate transport path. In the present example, the reference image may be a plurality of lines in which actual distance reference values may correspond to each of the lines. Thus, one portion of the reference image may be one line of the plurality of lines. In block S540, an amount of angular movement of the transport roller is detected to obtain an expected distance of substrate travel along the substrate transport path. For example, the expected distance my equal the angular movement multiplied by the radius of the transport roller as identified in Equation 1. In block S550, an offset value is determined based on a difference between the actual distance and the expected distance of the substrate advancement.

In an example, the method of calibrating a transport roller of an image forming apparatus may also include selectively applying the determined offset value to the transport roller. The offset value may be applied, for example, in a form one of an increase or a decrease in the amount angular movement of the transport roller. The method illustrated in FIG. 5 may also include applying pressure to orient the substrate with respect to a platen unit and the fluid ejector unit. The method may also include adding a calibration value corresponding to a variation of at least one of the nozzle spacing distance and drop placement to the offset value.

The present disclosure has been described using non-limiting detailed descriptions of examples thereof that are provided by way of example and are not intended to limit the scope of the disclosure. It should be understood that features and/or operations described with respect to one example may be used with other example and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may describe structure, acts or details of structures and acts that may not be essential to the disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

a transport roller having a radius and a circumference, the transport roller configured to move a substrate a distance along a substrate transport path;

a fluid ejector unit including a plurality of nozzles arranged in an array having an array height in a direction transverse to the substrate transport path equal to or greater than the circumference of the transport roller, the fluid ejector unit configured to eject fluid through the nozzles to form a plurality of lines corresponding to actual distance reference values of substrate advancement on the substrate; and a determination unit configured to determine an offset value based on a difference between an actual distance of the substrate advancement along the substrate transport path based on at least one line of the plurality of lines and an expected distance based on an amount of movement of the transport roller; and wherein the plurality of lines allows the determination unit to determine the actual distance of substrate advancement corresponding up to at least a full rotation of the transport roller.

2. The apparatus according to claim 1, wherein the determination unit comprises:

a line detection unit configured to detect the plurality of lines formed by the fluid ejector unit;

a movement detection unit configured to detect the amount of movement of the transport roller; and an offset determination unit in communication with the line detection unit and the movement detection unit, the offset determination unit configured to determine the offset value based on the difference between the actual distance of substrate advancement along the substrate transport path based on the detection of the at least one line by the line detection unit and the expected distance based on the detection of the amount of movement of the transport roller by the movement detection unit.

3. The apparatus according to claim 2, wherein the line detection unit is an optical sensor disposed downstream from the fluid ejector unit in a substrate transport direction.

4. The apparatus according to claim 3, wherein the movement detection unit is an encoder sensor disposed on the transport roller, the movement detection unit is configured to detect angular movement of the transport roller.

5. The apparatus according to claim 4, wherein the offset determination unit is configured to determine the actual distance based on a respective actual distance reference value corresponding to the at least one line detected by the line detection unit.

6. The apparatus according to claim 5, wherein the offset determination unit is configured to determine the expected distance based on the amount of angular movement of the transport roller detected by the movement detection unit and the radius of the transport roller.

7. The apparatus according to claim 6, wherein the plurality of lines are spaced apart from each other by a predetermined line spacing distance, and a distance between a first line and a last line of the plurality of lines is equal to the array height.

8. The apparatus according to claim 7, wherein the plurality of lines are parallel and the predetermined line spacing distance is equal to a nozzle spacing distance between nozzles of the fluid ejector unit in the direction transverse to the substrate transport path.

9. The apparatus according to claim 7, further comprising:

an offset application unit configured to selectively apply the offset value determined by the offset determination unit to the transport roller in a form one of an increase or decrease in the amount rotation of the transport roller.

10. The apparatus according to claim 9, further comprising a platen unit disposed across from the fluid ejector unit, the platen unit configured to receive the substrate; and a pressure unit configured to apply pressure to orient the substrate with respect to the platen unit and the fluid ejector unit.

11. The apparatus according to claim 10, further comprising:

a memory;

a calibration value corresponding to a variation of at least one of the nozzle spacing distance and drop placement stored in the memory, wherein the calibration value is factored into the offset value.

12. An image forming apparatus, comprising:

a transport roller having a radius and a circumference, the transport roller configured to move a substrate a distance along a substrate transport path;

a fluid ejector unit including a plurality of nozzles arranged in an array having an array height in a direction transverse to the substrate transport path equal to or greater than the circumference of the transport roller, the fluid ejector unit configured to eject fluid through the nozzles to form a plurality of lines corresponding to actual distance reference values of substrate advancement on the substrate;

a determination unit configured to determine an offset value based on a difference between an actual distance of the substrate advancement along the substrate transport path based on at least one line of the plurality of lines and an expected distance based on an amount of movement of the transport roller;

a memory; and a calibration value corresponding to a variation of at least one of the nozzle spacing distance and drop placement stored in the memory; and wherein the calibration value is factored into the offset value.

13. An image forming apparatus, comprising:

a transport roller having a radius and a circumference, the transport roller configured to move a substrate a distance along a substrate transport path;

a fluid ejector unit including a plurality of nozzles arranged in an array having an array height in a direction transverse to the substrate transport path greater than the circumference of the transport roller, the fluid ejector unit configured to eject fluid through the nozzles to form a plurality of lines corresponding to actual distance reference values of substrate advancement on the substrate; and a determination unit configured to determine an offset value based on a difference between an actual distance of the substrate advancement along the substrate transport path based on at least one line of the plurality of lines and an expected distance based on an amount of movement of the transport roller, the determination unit including:

a line detection unit configured to detect the plurality of lines formed by the fluid ejector unit such that the line detection unit is an optical sensor disposed downstream from the fluid ejector unit in a substrate transport direction;

a movement detection unit configured to detect the amount of movement of the transport roller such that the movement detection unit is an encoder sensor disposed on the transport roller, the movement detection unit is configured to detect angular movement of the transport roller; and an offset determination unit in communication with the line detection unit and the movement detection unit, the offset determination unit configured to determine the offset value based on the difference between the actual distance of substrate advancement along the substrate transport path based on the detection of the at least one line by the line detection unit and the expected distance based on the detection of the amount of movement of the transport roller by the movement detection unit.

* * * * *